US009099824B2

(12) United States Patent
Tu et al.

(10) Patent No.: US 9,099,824 B2
(45) Date of Patent: Aug. 4, 2015

(54) ELECTRICAL CONNECTOR

(71) Applicant: Wistron Corporation, New Taipei (TW)

(72) Inventors: Wei-Chin Tu, New Taipei (TW); Kuei-Yuan Chung, New Taipei (TW); Ting-Yao Cheng, New Taipei (TW); Yu-Teng Chang, New Taipei (TW)

(73) Assignee: WISTRON CORPORATION, New Taipei (TW)

( * ) Notice: Subject to any disclaimer, the term of this patent is extended or adjusted under 35 U.S.C. 154(b) by 1 day.

(21) Appl. No.: 14/170,522

(22) Filed: Jan. 31, 2014

(65) Prior Publication Data

US 2015/0037993 A1 Feb. 5, 2015

(30) Foreign Application Priority Data

Aug. 5, 2013 (TW) ..... 102127940 A

(51) Int. Cl.

| | |
|---|---|
| ***H01R 24/04*** | (2006.01) |
| ***H01R 27/00*** | (2006.01) |
| ***H01R 12/71*** | (2011.01) |
| ***H01R 24/58*** | (2011.01) |
| *H01R 107/00* | (2006.01) |

(52) U.S. Cl.

CPC ..... *H01R 27/00* (2013.01); *H01R 12/712* (2013.01); *H01R 24/58* (2013.01); *H01R 2107/00* (2013.01)

(58) Field of Classification Search

CPC .... H01R 31/06; H01R 23/7073; H01R 24/58; H01R 13/514

USPC ..... 439/638, 660, 668, 669, 701

See application file for complete search history.

(56) References Cited

U.S. PATENT DOCUMENTS

| | | | | |
|---|---|---|---|---|
| 5,823,796 | A * | 10/1998 | Bethurum | 439/76.1 |
| 6,394,852 | B1 * | 5/2002 | Huang | 439/669 |
| 6,461,198 | B1 * | 10/2002 | Chao | 439/668 |
| 6,616,487 | B1 * | 9/2003 | Lai | 439/668 |
| 6,786,778 | B2 * | 9/2004 | Lai | 439/701 |
| 6,991,497 | B1 * | 1/2006 | Lin | 439/668 |
| 7,789,704 | B2 * | 9/2010 | Ho | 439/606 |
| 7,824,229 | B1 * | 11/2010 | Yang et al. | 439/669 |
| 7,997,939 | B2 * | 8/2011 | Akaiwa et al. | 439/669 |
| 2011/0093643 | A1 | 4/2011 | Hung et al. | |

* cited by examiner

*Primary Examiner* — Thanh Tam Le

(74) *Attorney, Agent, or Firm* — DLA Piper LLP (US)

(57) ABSTRACT

An electrical connector is adapted to be alternatively connected to an audio plug or another device plug. The electrical connector includes a hollow insulating main body having an insertion opening that has an audio insertion portion corresponding in shape to the audio plug and a main insertion portion corresponding in shape to the another device plug, a main terminal module including main terminals partially exposed in a receiving space of the insulating main body for electrical connection with the another device plug, and an audio terminal module including audio terminals partially exposed in the receiving space for electrical connection with the audio plug.

7 Claims, 5 Drawing Sheets

ELECTRICAL CONNECTOR

CROSS-REFERENCE TO RELATED APPLICATION

This application claims priority of Taiwanese Application No. 102127940, filed on Aug. 5, 2013, the entire disclosure of which is incorporated herein by reference.

BACKGROUND OF THE INVENTION

1. Field of the Invention

The invention relates to an electrical connector, particularly to an electrical connector adapted to be alternatively connected to an audio plug or another device plug for transferring data, power or audio signals.

2. Description of the Related Art

With the trend that portable electronic devices are becoming ever more popular, miniaturizing electronic devices to be more portable has become a strategic goal for research and development in related industries.

Currently, a portable electronic device such as notebook computer, a tablet PC or a mobile phone usually has an electrical connector for connecting to an external device for transferring data or power, e.g., a USB socket connectable to a USB plug. The portable electronic device usually also has an audio connector, e.g., an audio jack, connectable to an audio plug for transferring audio signals.

However, the separated audio and electrical connectors have to be connected electrically and respectively to different sections of a circuit board of the portable device, hence occupying a relatively larger portion of the circuit board and creating more challenges for miniaturization. In addition, separate openings have to be formed in the casing of the portable electrical device for the audio connector and the electrical connector which occupies a relatively larger portion of the casing and adversely affect the aesthetic appearance of the portable electronic device.

SUMMARY OF THE INVENTION

Therefore, an object of the present invention is to provide an electrical connector that is adapted to be alternatively connected to a first type of connector plug or a second type of connector plug, in which the first type is an audio plug and the second type is another device plug. Another object of the present invention is to provide an electrical connector for reducing space occupied on a circuit board of an electronic device. Another object of the present invention is to provide an electrical connector for reducing the number of openings required to be formed in the casing of the electrical device.

According to the present invention, there is provided an electrical connector including a hollow insulating main body, a main terminal module and an audio terminal module. The hollow insulating main body has a receiving space therein and an insertion opening. The insertion opening communicates the receiving space and an external environment, and has a main insertion portion corresponding in shape to a cross-section of the second type of connector plug and an audio insertion portion corresponding in shape to a cross-section of the first type of connector plug. The main insertion portion and the audio insertion portion partially overlap each other.

The main terminal module is connected to the insulating main body and includes a plurality of main terminals. Each of the main terminals has an exposed part exposed in the receiving space. The audio terminal module is connected to the insulating main body and includes a plurality of audio terminals. Each of the audio terminals has an exposed part exposed in the receiving space.

The second type of connector plug is permitted to be inserted into the insulation main body through the main insertion portion of the insertion opening and be fixed in the receiving space, such that contacts of the second type of connector plug are electrically connected to the exposed parts of the main terminals.

The first type of connector plug is permitted to be inserted into the insulation main body through the audio insertion portion of the insertion opening and be fixed in the receiving space, such that contacts of the first type of connector plug are electrically connected to the exposed parts of the audio terminals.

BRIEF DESCRIPTION OF THE DRAWINGS

Other features and advantages or the present invention will become apparent in the following detailed description of the embodiments with reference to the accompanying drawings, of which.

DETAILED DESCRIPTION OF THE EMBODIMENTS

Figure 1:
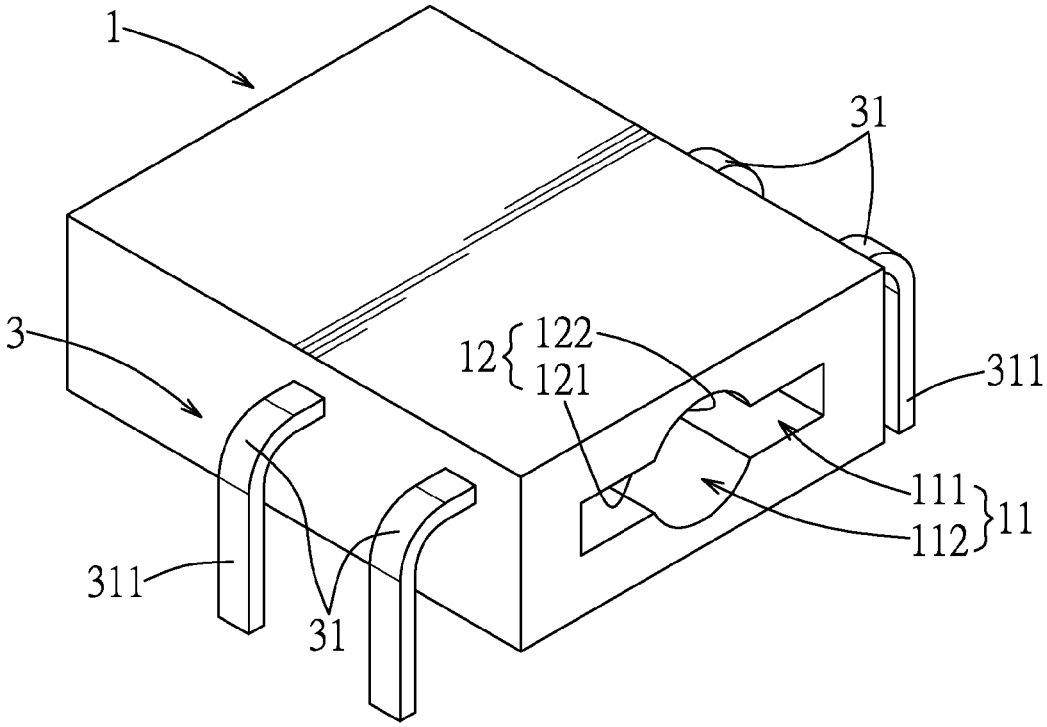
FIG. 1 is a perspective view of a first embodiment of an electrical connector according to the present invention.
Figure 2:
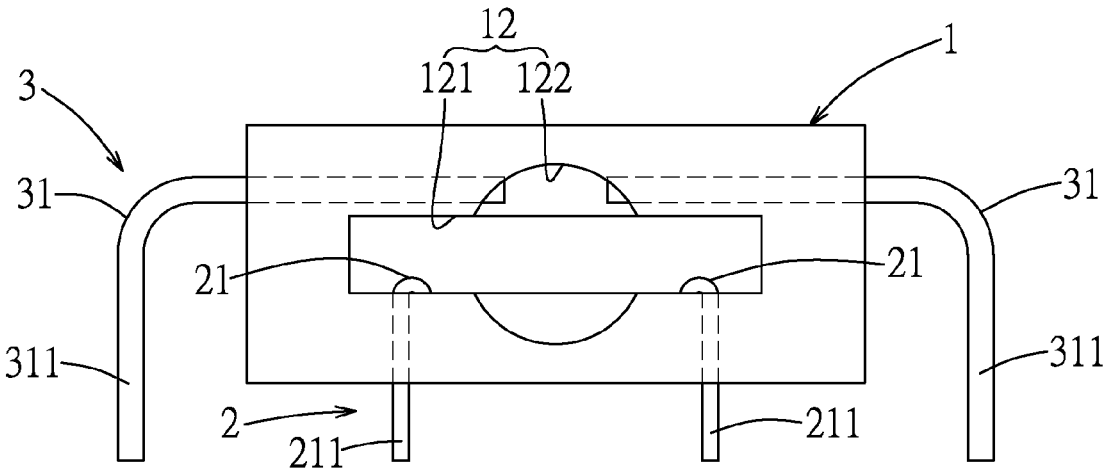
FIG. 2 is a front view of the first embodiment illustrating an insertion opening.
Figure 3:
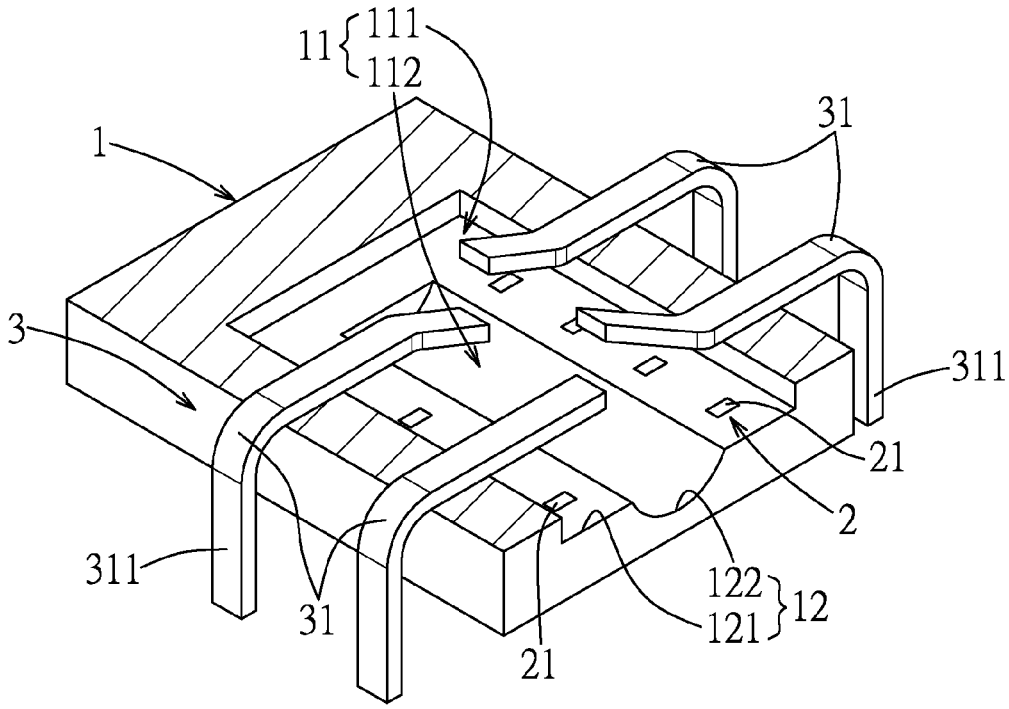
FIG. 3 is a perspective partly cutaway view illustrating an internal structure of the first embodiment.
Figure 4:
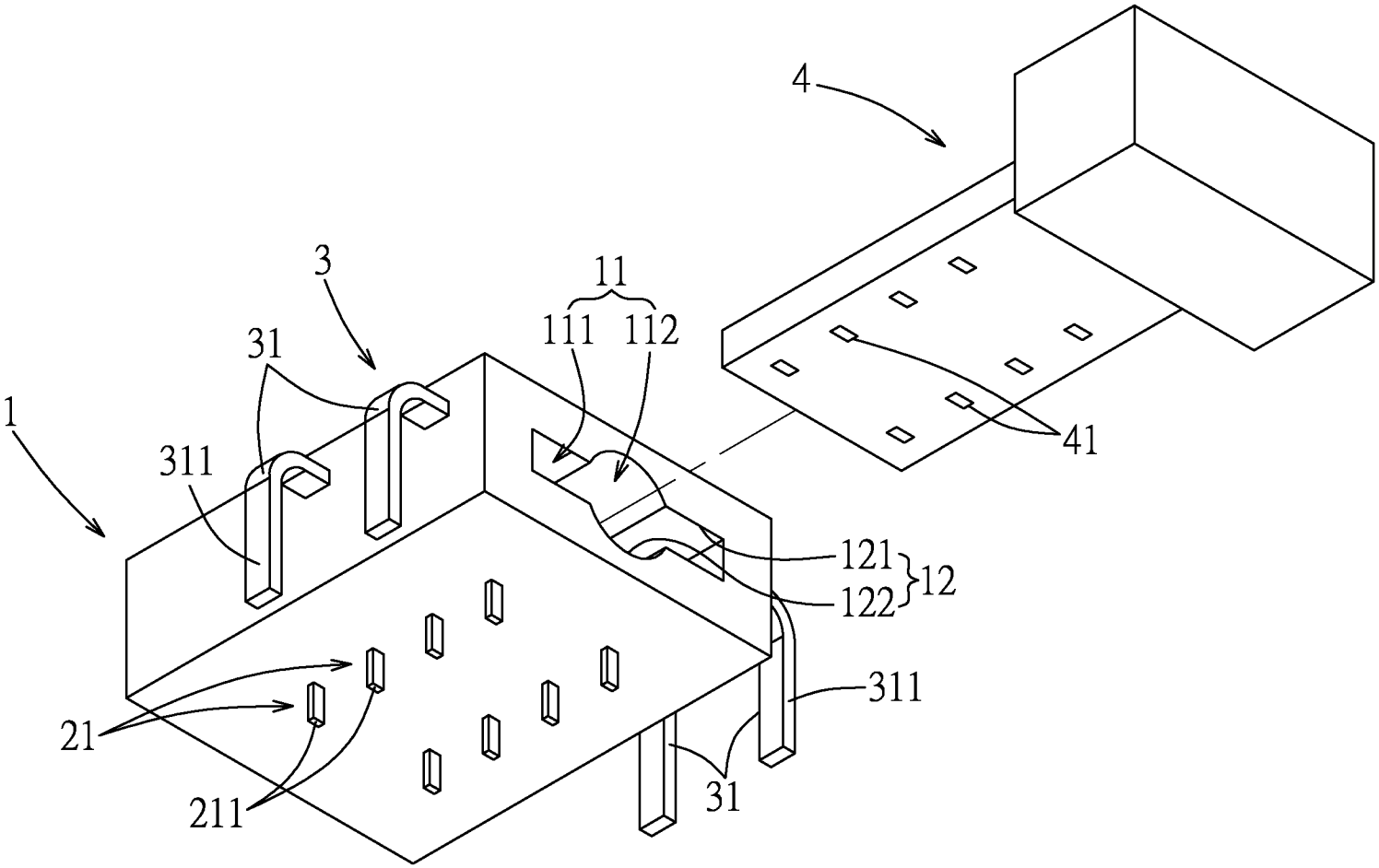
FIG. 4 is a perspective view illustrating a second type of connector plug and the first embodiment.
Figure 5:
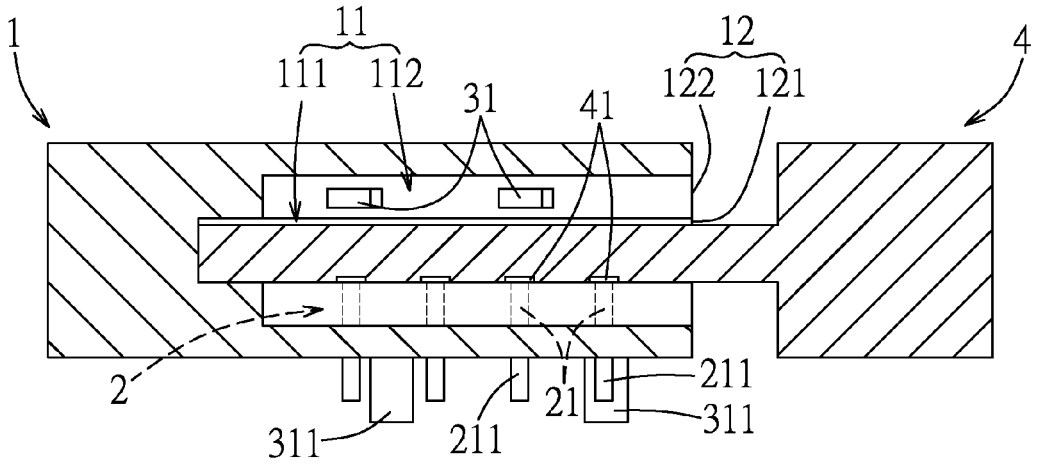
FIG. 5 is a sectional view illustrating the second type of connector plug being inserted into the first embodiment.
Figure 6:
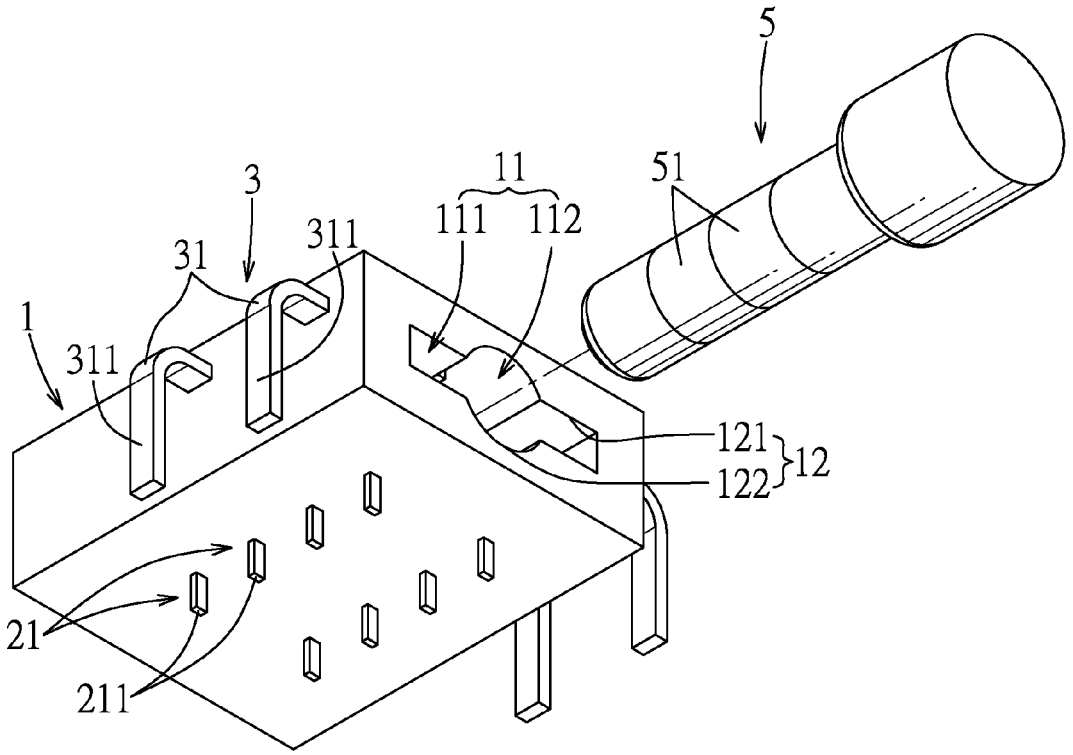
FIG. 6 is a perspective view illustrating a first type of connector plug and the first embodiment.
Figure 7:
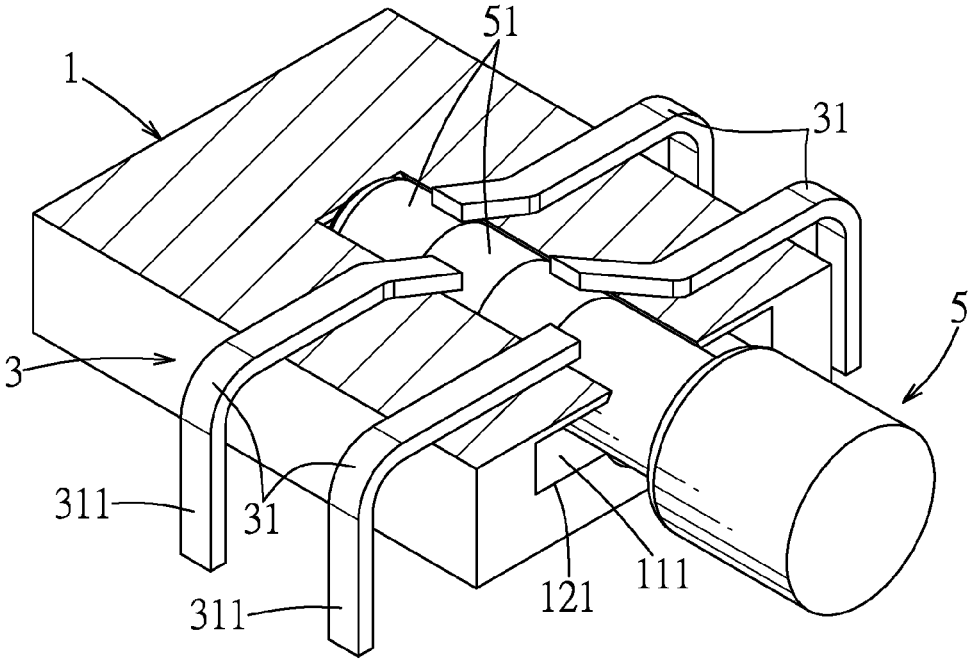
FIG. 7 is a perspective partly cutaway view illustrating the first type of connector plug being inserted into the first embodiment.

FIGS. 1, 2 and 3 illustrate a first embodiment of an electrical connector according to the present invention that is adapted to be alternatively and electrically connected to first or second types of connector plugs 5, 4 for transferring data, power or audio signals. The first type of connector plug 5 is an audio plug (as shown in FIG. 6) and the second type of connector plug 4 is another device plug (as shown in FIG. 4).

The electrical connector includes a hollow insulating main body 1, and a main terminal module 2 and an audio terminal module 3 connected to the insulating main body 1. The insulating main body 1 has a receiving space 11, and an insertion opening 12 for communicating the receiving space 11 and an external environment.

The receiving space 11 includes a main receiving portion 111 corresponding in shape to the second type of connector plug 4 and an audio insertion portion 112 corresponding in shape to the first type of connector plug 5. The main receiving portion 111 and the audio receiving portion 112 partially overlap each other to reduce the dimensions of the receiving space 11.

The insertion opening 12 includes a main insertion portion 121 corresponding in shape to a cross-section of the second type of connector plug 4 and an audio insertion portion 122 corresponding in shape to a cross-section of the first type of connector plug 5. The main insertion portion 121 and the audio insertion portion 122 partially overlap each other to reduce the dimension of the insertion opening 12.

The main terminal module 2 includes a plurality of main terminals 21 connected to the insulating main body 1. Each of the main terminals 21 has an exposed part exposed in the receiving space 11 and a first tail part 211 extending outwardly of the insulating main body 1. The audio terminal module 3 includes a plurality of audio terminals 31 connected to the insulating main body 1. Each of the audio terminals 31 has an exposed part exposed in the receiving space 11 and a second tail part 311 extending outwardly of the insulating main body 1.

The first tail part 211 of each of the main terminals 21 and the second tail part 311 of each of the audio terminals 31 are adapted to be electrically connected to a circuit board (not shown), so that the electrical connector is mounted to the circuit board and is able to transfer data, power or audio signals. In this embodiment, the exposed part of each of the main terminals 21 is exposed in an end section of the receiving space 11 (the lower end as shown in FIG. 2) and the exposed part of each of the audio terminals 31 is exposed in an opposite end section of the receiving space 11 (the upper end as shown in FIG. 2). Such arrangement prevents interferences between the main terminals 21 and the audio terminals 31 in the receiving space 11 and facilitates the manufacturing process of the electrical connector.

Referring to FIGS. 4, 5, 6 and 7, the electrical connector is adapted to be alternatively connected to the first type of connector plug 5 or the second type of connector plug 4. The second type of connector plug 4 is permitted to be inserted into the insulating main body 1 through the main insertion portion 121 of the insertion opening 12 and is retained fittingly in the main receiving portion 111 of the receiving space 11, so that contacts 41 of the second type of connector plug 4 are electrically and respectively connected to the exposed parts of the main terminals 21 to enable transfer of data and power between the second type of connector plug 4 and the electrical connector. The first type of connector plug 5 is permitted to be inserted the insulating main body 1 through the audio insertion portion 122 of the insertion opening 12 and is retained fittingly in the audio receiving portion 112 of the receiving space 11, so that contacts 51 of the first type of connector plug 5 are electrically and respectively connected to the exposed parts of the audio terminals 31 to enable transfer of audio signals between the first type of connector plug 5 and the electrical connector.

In this embodiment, the exposed parts of the main terminals 21 are exposed in the section of the main receiving portion 111 of the receiving space 11 that does not overlap the audio receiving portion 112. Therefore, no interference is caused with the main terminals 21 when the first type of connector plug 5, which is the audio plug, is plugged into the electrical connector. Similarly, the exposed parts of the audio terminals 31 are exposed in the section of the audio receiving portion 112 of the receiving space 11 that does not overlap the main receiving portion 111. Therefore, no interference is caused with the audio terminals 31 when the second type of connector plug 4 is plugged into the electrical connector.

Figure 8:
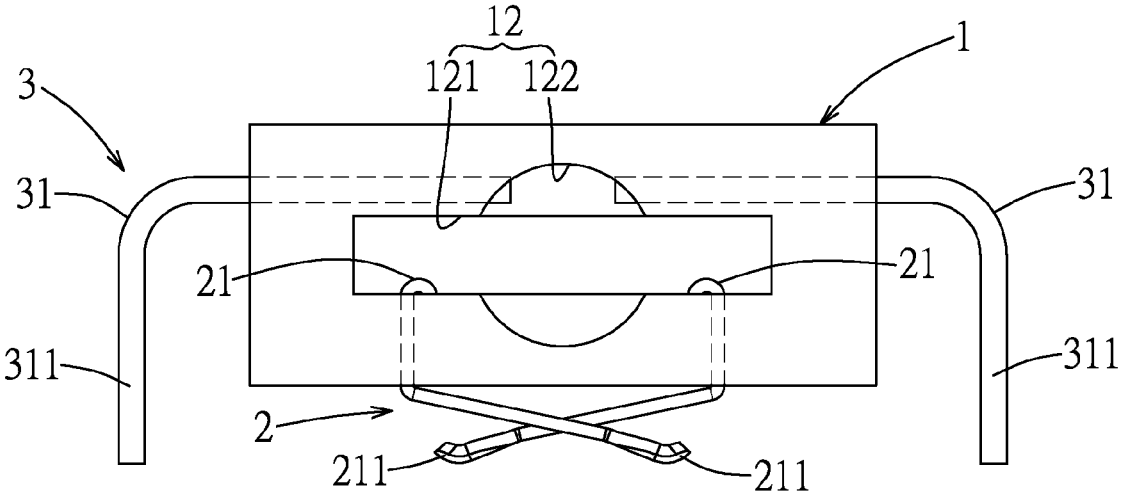
FIG. 8 is a front view of a second embodiment of the electrical connector according to the present invention.

FIG. 8 illustrates a second embodiment of an electrical connector according to the present invention. The second embodiment is similar to the first embodiment except that a different mounting technology of the main terminals 21 to the circuit board (not shown) is utilized. In the first embodiment, the first tail part 211 of each of the main terminals 21 and the second tail part 311 of each of the audio terminals 31 are mounted to the circuit board using through-hole technology (see FIG. 2). In this embodiment, the first tail part 211 of each of the main terminals 21 is mounted to the circuit board using crimp technology.

A person skilled in the art should understand that the main terminals 21 and the audio terminals 31 are not limited to the aforementioned types. Any other terminal types can be utilized as long as the main terminals 21 and the audio terminals 31 can be electrically connected to the corresponding one of the second type of connector plug 5 and the first type of connector plug 4 when the corresponding type of plugs is inserted into the receiving space 11.

To conclude, the electrical connector according to the present invention includes the main receiving and insertion portions 111, 121 corresponding in shape to the second type of connector plug 4 and the audio receiving and insertion portions 112, 122 corresponding in shape to the first type of connector plug 5, and allows the electrical connector to be compatible with both the first type of connector plug 5, which is an audio plug, and the second type of connector plug, which is another device plug. The electrical connector further includes the main terminal module 2 and the audio terminal module 3 with respective exposed parts exposed in the receiving space 11 for connection with the first type of connector plug 5 and the second type of connector plug 4. Therefore, the single electrical connector is sufficient in an electronic device for being alternatively connected to two types of plugs.

A reduced number of connectors not only effectively decreases the size of the required portion of the circuit board of the electronic device, but also decreases the number of openings formed in a casing of the electronic device. Restrictions in miniaturization and aesthetic design of the electronic device ace reduced consequentially.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector adapted to be connected electrically and alternatively to first or second types of connector plugs, the first type being an audio plug, said electrical connector comprising:

a hollow insulating main body having a receiving space therein, and an insertion opening for communicating said receiving space and an external environment, and that has a main insertion portion corresponding in shape to a cross-section of the second type of connector plug, and an audio insertion portion corresponding in shape to a cross-section of the first of type connector plug, said main insertion portion and said audio insertion portion partially overlapping each other;

a main terminal module connected to said insulating main body and including a plurality of main terminals, each of said main terminals having an exposed part that is exposed in said receiving space; and an audio terminal module connected to said insulating main body and including a plurality of audio terminals, each of said audio terminals having an exposed part that is exposed in said receiving space;

wherein, the second type of connector plug is permitted to be inserted into said insulation main body through said main insertion portion of said insertion opening and be fixed in said receiving space, such that contacts of the second type of connector plug are connected electrically to said exposed parts of said main terminals; and wherein, the first type of connector plug is permitted to be inserted into said insulation main body through said audio insertion portion of said insertion opening and be fixed in said receiving space, such that contacts of the first type of connector plug are connected electrically to said exposed parts of said audio terminals.

2. The electrical connector as claimed in claim 1, wherein:

said exposed part of each of said main terminals is exposed in an end section of said receiving space; and said exposed part of each of said audio terminals is exposed in an opposite end section of said receiving space.

3. The electrical connector as claimed in claim 1, wherein said receiving space has a main receiving portion corresponding in shape to the second type of connector plug, and an audio receiving portion corresponding in shape to the first type of connector plug, said main receiving portion and said audio receiving portion partially overlapping each other.

4. The electrical connector as claimed in claim 3, wherein:

said exposed part of each of said main terminals is exposed in a section of said main receiving portion that does not overlap said audio receiving portion; and said exposed part of each of said audio terminals is exposed in an opposite end section of said audio receiving portion that does not overlap said main receiving portion.

5. The electrical connector as claimed in claim 3, wherein:

each of said main terminals further has a first tail part extending outwardly of said insulating main body;

each of said audio terminals further has a second tail part extending outwardly of said insulating main body; and said first tail part of each of said main terminals and said second tail part or each or said audio terminals are electrically connected to a circuit board.

6. The electrical connector as claimed in claim 5, wherein at least one of said first tail parts of said main terminals and said second tail parts of said audio terminals is configured as a through-hole type.

7. The electrical connector as claimed in claim 5, wherein at least one of said first tail parts of said main terminals and said second tail parts of said audio terminals is configured as a crimp type.

* * * * *